US009039820B2

(12) United States Patent
Han

(10) Patent No.: US 9,039,820 B2
(45) Date of Patent: May 26, 2015

(54) WET-SEPARATION TYPE DUST COLLECTOR FOR VACUUM

(75) Inventor: Jung Gyun Han, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 785 days.

(21) Appl. No.: 13/318,008

(22) PCT Filed: Feb. 9, 2010

(86) PCT No.: PCT/KR2010/000802

§ 371 (c)(1),
(2), (4) Date: Jan. 6, 2012

(87) PCT Pub. No.: WO2010/126222

PCT Pub. Date: Nov. 4, 2010

(65) Prior Publication Data

US 2012/0111201 A1 May 10, 2012

(30) Foreign Application Priority Data

Apr. 29, 2009 (KR) ..... 10-2009-0037702

(51) Int. Cl.

| | |
|---|---|
| ***A47L 9/16*** | (2006.01) |
| ***A47L 9/18*** | (2006.01) |
| ***B04C 5/185*** | (2006.01) |
| *B04C 9/00* | (2006.01) |

(52) U.S. Cl.

CPC ..... *A47L 9/1608* (2013.01); *A47L 9/1683* (2013.01); *A47L 9/183* (2013.01); *B04C 5/185* (2013.01); *B04C 2009/008* (2013.01)

(58) Field of Classification Search

None

See application file for complete search history.

(56) References Cited

U.S. PATENT DOCUMENTS

| | | | | | |
|---|---|---|---|---|---|
| 1,754,126 | A | * | 4/1930 | Stievenart | 96/316 |
| 2,527,015 | A | * | 10/1950 | Lhota | 261/91 |
| 3,348,830 | A | * | 10/1967 | Pearl et al. | 261/161 |
| 5,704,954 | A | * | 1/1998 | Takagi | 96/286 |

FOREIGN PATENT DOCUMENTS

| | | | |
|---|---|---|---|
| JP | 2006006837 | A * | 1/2006 |
| JP | 2007111397 | A * | 5/2007 |
| JP | 2008029769 | A * | 2/2008 |

OTHER PUBLICATIONS

International Search Report for PCT/KR2010/000802, mailed Oct. 8, 2010.

* cited by examiner

*Primary Examiner* — Duane Smith
*Assistant Examiner* — Pankti Patel
(74) *Attorney, Agent, or Firm* — Staas & Halsey LLP

(57) ABSTRACT

The present invention relates to a wet-separation type dust collector for a vacuum cleaner. Said dust collector comprises: a dust collecting unit for collecting dust discharged from a centrifuging unit, and a water storage unit for producing liquid drops to be sprayed into said dust collecting unit, and said dust collecting unit has a plurality of spraying holes for spraying liquid drops by means of a vacuum pressure created in the inner side of the vacuum cleaner. By the above configuration, the dust collector of the present invention can effectively separate dust particles from the centrifuging unit by evenly spraying liquid drops into the entire interior of the dust container. In addition, the dust collector prevents the backflow of floating dust particles in the dust container by rapidly transferring the dust particles towards the lower side of the dust container.

9 Claims, 4 Drawing Sheets

WET-SEPARATION TYPE DUST COLLECTOR FOR VACUUM

CROSS-REFERENCE TO RELATED APPLICATION

This application is a U.S. National Stage and claims the benefit under 35 U.S.C. Section 371, of PCT International Application No. PCT/KR2010/000802, filed Feb. 9, 2010, which claimed priority to Korean Application No. 10-2009-0037702, filed Apr. 29, 2009 in the Korean Patent Office, the disclosures of which are hereby incorporated by reference.

TECHNICAL FIELD

The present invention relates to a dust collector for a vacuum cleaner, and more particularly to a wet separation type dust collector to create liquid droplets so as to separate fine dust particles in a vacuum cleaner for domestic, industrial, business use, and the like.

BACKGROUND ART

In general, a dust collector for a centrifuging type vacuum cleaner which is known as a cyclone cleaner includes a centrifuge to rotate air containing dust so as to separate dust particles by centrifugal force, and a dust container to collect the separated dust particles.

Such a centrifuging type vacuum cleaner does not need a separate dust bag for collection of dust. Also, the centrifuging type vacuum cleaner causes no problem in that air permeability is deteriorated due to foreign matter which is caught in the dust bag unlike vacuum cleaners to separate dust particles using the dust bag, thereby not causing deterioration in cleaning efficiency.

However, since the centrifuging type vacuum cleaner separates dust particles by centrifugal force, there is a problem in that light-weight and small fine dust particles may not be separated from air introduced into the dust collector by centrifugal force. Thus, the fine dust particles which are not separated block a prefilter or an exhaust filter, thereby resulting in deterioration in air permeability. Consequently, a problem which frequently repairs the prefilter or the exhaust filter may be generated.

Accordingly, in order to solve the problem of deterioration in fine dust separation efficiency, the related art discloses vacuum cleaners which perform cleaning using water, for example, a steam spraying mode, a wet dust separation mode, or the like.

Examples of the above-mentioned related art include Korean Patent No. 10-813537 entitled "steam vacuum cleaner" (hereinafter, referred to as 'related art 1') and Korean patent Laid-open publication No. 10-2007-19920 entitled "vacuum cleaner" (hereinafter, referred to as 'related art 2').

Related art 1 discloses a steam vacuum cleaner which performs cleaning in such a manner that steam is created by heating water stored in a water tank pump with a heater and is then sprayed onto a cleaning surface. In this case, the steam allows bacteria, microorganisms, etc. of the cleaning surface to be sterilized, and water created by liquefaction of the steam enables cohesion of dust and the like. As a result, cleaning efficiency of the cleaning surface may be improved.

Also, related art 2 discloses a vacuum cleaner which may easily separate fine dust particles in such a manner that the dust collector is provided at a base portion thereof with a liquid droplet generating unit and a liquid droplet injection unit so as to spray liquid droplets into the dust collector.

All the related arts described above prevent fine dust separation efficiency in a centrifuging portion from being deteriorated by collection or cohesion of fine dust using liquid.

However, in the case of directly spraying steam onto the cleaning surface as described in related art 1, a separate sprayer must be provided in order to spray the steam.

Also, since moist dust particles generated by liquefaction of the steam are suctioned into the steam vacuum cleaner when dust is removed after spraying the steam onto the cleaning surface, there is a problem in that configurations of an air passage including a suction nozzle may be contaminated.

In addition, since water and dust are directly exposed to an air current within the dust collector, re-scattering may be generated in a mixed state of the water and the dust.

Furthermore, water containing dust flows into a main body, thereby also causing inconvenience such as blockage of a filter.

In the case of related art 2, since the dust collector generates liquid droplets at the base portion thereof, there are problems in that the liquid droplets are not evenly distributed throughout an upper portion thereof while cohesion efficiency of dust by the liquid droplets within the dust collector is deteriorated.

Also, since related art 2 has a configuration which locally generates liquid droplets, generation efficiency of the liquid droplets may be deteriorated. Consequently, there is a problem which deteriorates fine dust separation efficiency by the liquid droplets.

DISCLOSURE

Technical Problem

Therefore, the present invention has been made in view of the above problems, and it is an object of the present invention to provide a wet separation type dust collector for a vacuum cleaner capable of automatically spraying liquid droplets without a separate spraying means and improving dust separation efficiency within a dust separation unit.

Technical Solution

In accordance with an aspect of the present invention, the above and other objects can be accomplished by the provision of a wet separation type dust collector for a vacuum cleaner including a dust collecting unit to collect dust particles discharged from a centrifuging unit, and a water storage unit to store water, wherein the dust collecting unit is formed at a side wall thereof with a plurality of liquid droplet spray holes so that liquid droplets are automatically sprayed into the dust collecting unit by vacuum pressure of the vacuum cleaner.

Each of the plural liquid droplet spray holes may be formed to have a different diameter in order to create liquid droplets having various sizes so that the liquid droplets may be bound with fine dust particles having various sizes. In this case, the liquid droplet spray hole should have a size at which generation of liquid droplets is not prevented due to surface tension of water. The liquid droplet spray hole may have a diameter of 0.3 mm to 10 mm so that generation of liquid droplets is not prevented due to surface tension of water, and may preferably have a diameter of 3 mm to 5 mm in order to more stably generate liquid droplets.

The water storage unit may have a smaller volume than the volume of the dust collecting unit in order to prevent water collected in the dust collecting unit from overflowing. The water storage unit may be coupled to an outer side surface of the dust collecting unit so as to form a water storage region at an outer side of the dust collecting unit.

The water storage unit may further include a handle portion to mount the dust collector to the vacuum cleaner or to separate the dust collector from the vacuum cleaner. The handle portion may have a water inlet opened at an upper portion thereof and be formed at a base portion thereof with a through hole to communicate with the water storage region of the water storage unit.

The dust collector of the present invention may further include water supply portions located within the water storage unit while being respectively formed at positions of the liquid droplet spray holes.

Each of the water supply portions may be formed at a base portion thereof so as to be submerged under the water stored in the water storage unit, and may have an inner diameter greater than the diameter of each liquid droplet spray hole.

Each of the water supply portions may be vertically provided at an outer peripheral surface of the side wall of the dust collecting unit. The inner diameter of the water supply portion may be formed so that rise of water is decreased by vacuum pressure of the vacuum cleaner.

Advantageous Effects

The present invention has an effect of easily separating fine dust particles which are not separated from a centrifuging unit by spraying liquid droplets having various sizes within a dust collecting unit.

Also, the present invention has an effect of allowing liquid droplets to be evenly distributed throughout upper portions of the dust collecting unit and the centrifuging unit by forming a plurality of liquid droplet spray holes along an upper wall of the dust collecting unit so as to spray liquid droplets, thereby improving separation efficiency of fine dust particles.

In addition, the present invention has an effect of rapidly moving fine dust particles, which float within the dust collecting unit, towards a base portion of the dust collecting unit, in order to prevent the floating fine dust particles from flowing backwards.

Furthermore, the present invention has an effect of easily raising water stored in a water storage unit up to the liquid droplet spray holes by provision of water supply portions, thereby improving generation efficiency of liquid droplets.

DESCRIPTION OF DRAWINGS

The above and other objects, features and other advantages of the present invention will be more clearly understood from the following detailed description taken in conjunction with the accompanying drawings, in which.

BEST MODE

Figure 1:
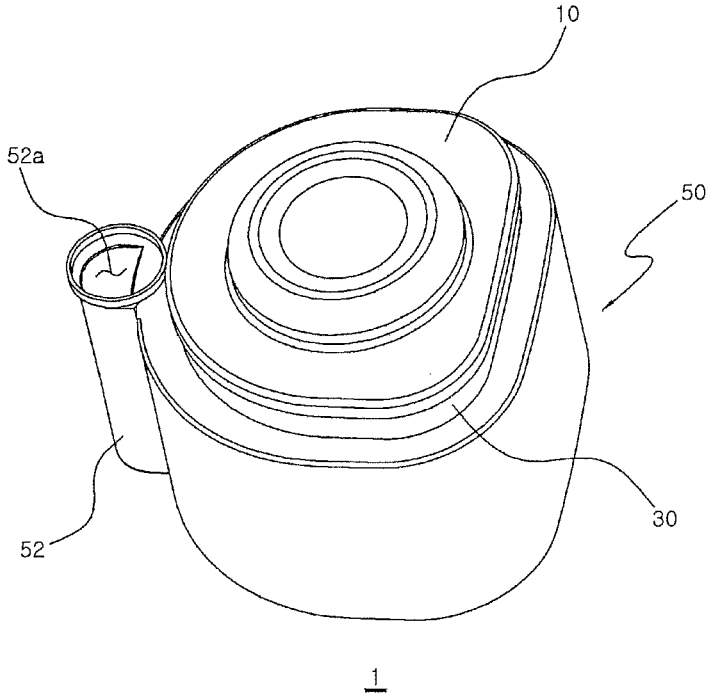
FIG. 1 is a perspective view illustrating a dust collector 1 for a vacuum cleaner according to an embodiment of the present invention.

Reference will now be made in detail to the embodiments of the present invention, examples of which are illustrated in the accompanying drawings, wherein like reference numerals refer to like elements throughout.

Figure 2:
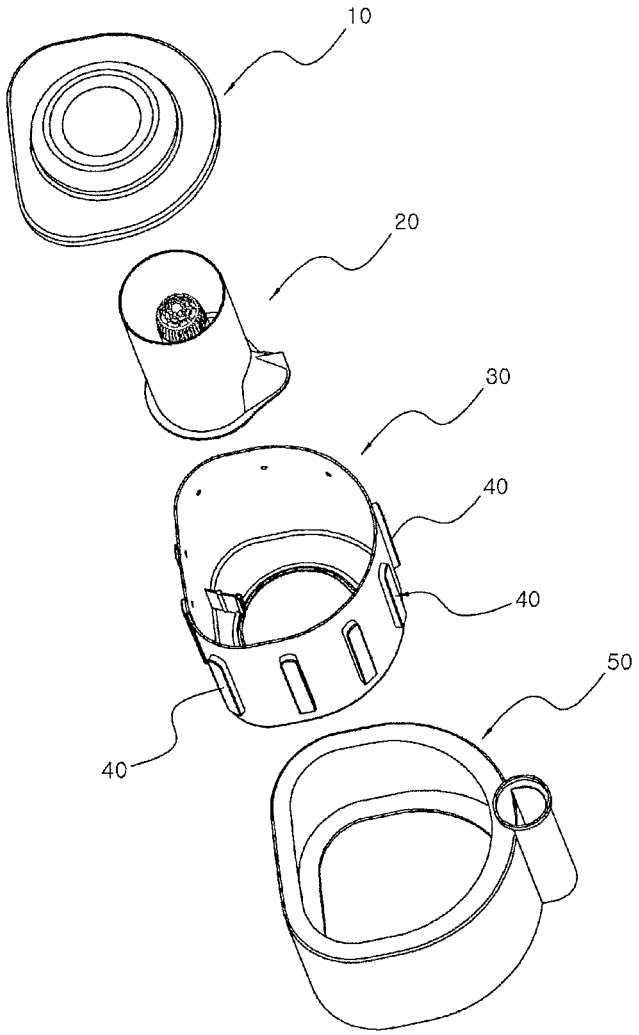
FIG. 2 is an exploded perspective view illustrating the dust collector 1 of FIG. 1.
Figure 3:
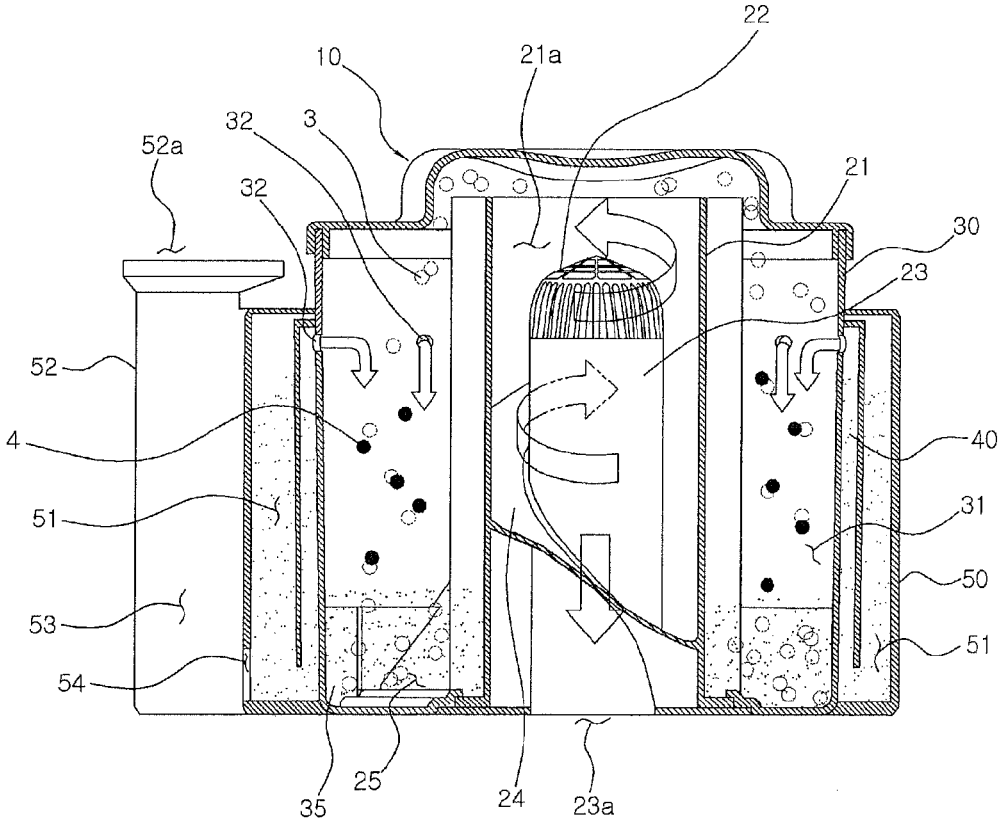
FIG. 3 is a sectional view illustrating the dust collector 1 of FIG. 1.
Figure 4:
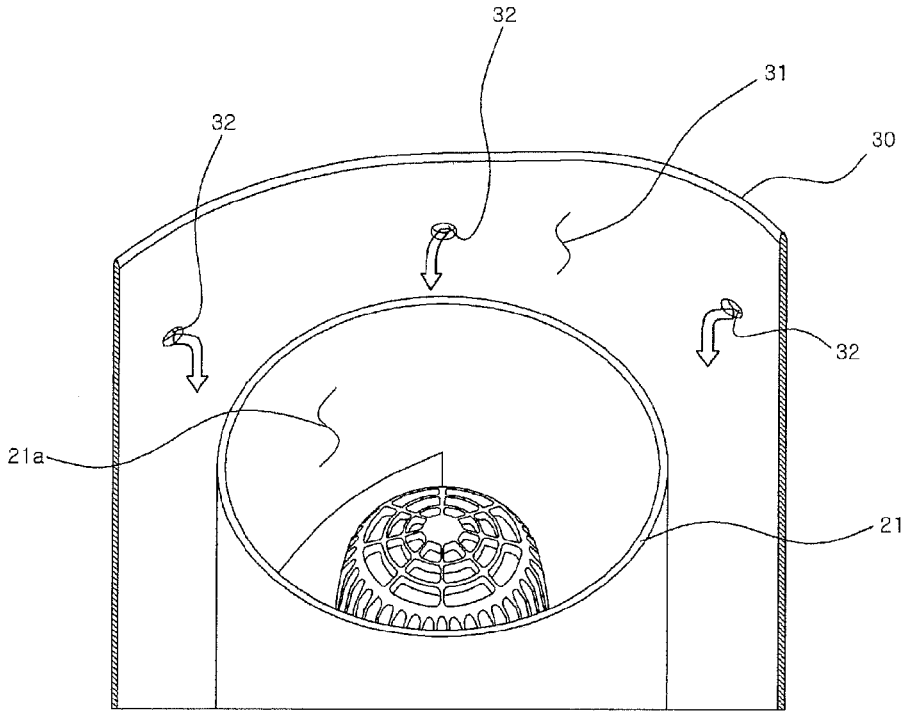
FIG. 4 is a partially cut away perspective view of the dust collector 1 illustrating arrangement of liquid droplet spray holes 32.

FIG. 1 is a perspective view illustrating a dust collector 1 for a vacuum cleaner according to an embodiment of the present invention. FIG. 2 is an exploded perspective view illustrating the dust collector 1 of FIG. 1. FIG. 3 is a sectional view illustrating the dust collector 1 of FIG. 1. FIG. 4 is a partially cut away perspective view of the dust collector 1 illustrating arrangement of liquid droplet spray holes 32.

The dust collector 1 shown in FIGS. 1 to 3 includes a cover 10, a centrifuging unit 20, a dust collecting unit 30, water supply portions 40, and a water storage unit 50.

In the dust collector 1 having the above-mentioned configuration, the centrifuging unit 20 is coupled to an inner side of the dust collecting unit 30, the water storage unit 50 is coupled to an outer side of the dust collecting unit 30, and the water supply portions 40 are coupled to an outer side surface of the dust collecting unit 30 within the water storage unit 50.

The centrifuging unit 20 is formed with an inlet 25. Also, the centrifuging unit 20 includes a centrifuging tube 21 by which a centrifuging region 21*a* is defined at an inner side of the centrifuging unit 20, an exhaust tube 23 formed at an inner side of the centrifuging tube 21, and a passage guide 24 formed at an outer side of the exhaust tube 23 in a spiral fashion in order to guide outdoor air introduced through the inlet 25 so that the outdoor air rotates along an outer peripheral surface of the exhaust tube 23 and moves upwards.

The exhaust tube 23 is opened at an upper portion thereof with a grill 22 while being formed, at a base portion thereof, as a cylinder tube composed of an exhaust hole 23*a* through which air is discharged.

The dust collecting unit 30 is sealed at an upper portion thereof by the cover 10 which is able to be opened and closed. Also, the dust collecting unit 30 is coupled at the inner side thereof with the centrifuging unit 20 and is formed as a container in which an outer side region of the centrifuging unit 20 is defined as a dust collecting region 31 to collect dust particles 3 separated by the centrifuging unit 20.

The dust collecting unit 30 is formed at an upper portion thereof with a plurality of liquid droplet spray holes 32 in a radial direction about the centrifuging unit 20, as shown in FIG. 4. Each of the liquid droplet spray holes 32 communicates the water storage unit 50 with the dust collecting region 31 in order to spray liquid droplets 4.

Each of the liquid droplet spray holes 32 has a height to allow the sprayed liquid droplets to prevent excessive introduction into the inner side of the centrifuging unit 20. In this case, the liquid droplet spray hole 32 is preferably formed to be located as close to the upper portion of the dust collecting unit 30 as possible.

In addition, each of the liquid droplet spray holes 32 is formed to have a different diameter so that the sprayed liquid droplets may have a variety of sizes. In this case, the liquid droplet spray hole 32 is formed to have a diameter of 0.3 mm to 10 mm, preferably 0.3 mm to 5 mm. This is because as follows. When the liquid droplet spray hole 32 is equal to or less than 0.3 mm in diameter, no water is smoothly supplied, thereby causing remarkable deterioration in generation of liquid droplets. On the other hand, when the liquid droplet spray hole 32 is equal to or greater than 10 mm in diameter, water is cohered due to surface tension of water. Consequently, the water is discharged in the form of a water stream which is cohered without scattering of water, thereby also causing remarkable deterioration in generation of liquid droplets.

Each of the water supply portions 40 is formed as a rectangular shaped tube which is opened at one side and base surfaces thereof, and is coupled to the outer side surface of the dust collecting unit 30 while including the liquid droplet spray hole 32 at an inner portion thereof so as to communicate with the dust collecting region 31 through the corresponding liquid droplet spray hole 32. Meanwhile, the water supply portion 40 may also be constructed in the form of a tube such as a hollow and flexible tube or the like.

In this case, a water storage region 51 in the water supply portions 40 communicates with the dust collecting region 31 through the opened base portion of each water supply portion 40 and the corresponding liquid droplet spray hole 32 located at the upper portion of the water supply portion 40. The water supply portion 40 extends at a lower portion thereof to the base surface within the water storage unit 50 so as to be submerged under the water stored in the water storage unit 50. Also, each water supply portion 40 having the above-mentioned configuration is limited in terms of vertical length and in inner diameter depending on the height and diameter of the corresponding liquid droplet spray hole 32.

That is, the water supply portion 40 is formed to have an inner diameter greater than the diameter of the liquid droplet spray hole 32 capable of supplying water so that liquid droplet generation rate of the liquid droplet spray hole 32 is deteriorated, whereas to have the inner diameter less than the diameter of the liquid droplet spray hole 32 which exceeds an amount of water capable of being raised due to pressure difference between the upper portion and the base portion in the water supply portion 40.

The inner diameter of the water supply portion 40 may also be determined through repeatedly performed experiments according to the dust collector.

The water storage unit 50 is coupled to the outer side of the dust collecting unit 30 so as to encase the entirety of the outer side of the dust collecting unit 30. The water storage unit 50 has, at one side thereof, a hollow handle portion 52 adapted for a water inlet 52*a* opened at an upper portion thereof so that water is supplied to the water storage unit 50.

The handle portion 52 is formed as a hollow tube which has a through hole 54 at base portion of an inner side of the handle portion 52. The handle portion 52 communicates with the water storage region 51 through the through hole 54 so as to replenish the water storage unit 50 with water.

The water storage unit 50 is preferably formed so that the water storage region 51 has a smaller volume than the volume of the dust collecting region 31 so as to prevent water collected in the dust collecting region 31 from overflowing outside the dust collecting region 31. Examples of a method of forming the volume of the water storage region 51 to be small than the volume of the dust collecting region 31 may include a way of forming the height of the water storage unit 50 to be lower than the height of the dust collecting unit 30.

In the configuration described above, the centrifuging unit 20 is fixedly coupled to the inner side of the dust collecting unit 30. In this case, the centrifuging tube 21 allows the centrifuging unit 20 to be separated from the dust collecting region 31.

The dust collecting unit 30 is coupled, at the outer side surface thereof, with the plural water supply portions 40 while including the liquid droplet spray holes 32 therein. Such coupled water supply portions 40 serve to supply the respective liquid droplet spray holes 32 with water to spray liquid droplets.

The dust collecting unit 30 coupled at the inner side thereof with the centrifuging unit 20 while being coupled at the outer side surface thereof with the plural water supply portions 40 is fixedly coupled to the inner side of the water storage unit 50. In this case, a wall constructing the dust collecting unit 30 allows the water storage region 51 of the water storage unit 50 to be divided from the dust collecting region 31.

As described above, after the centrifuging unit 20, the dust collecting unit 30, the water supply portions 40, and the water storage unit 50 are coupled, the cover 10 seals the opened upper portion of the dust collecting unit 30 so as to allow opening and closing thereof.

Hereinafter, a wet dust separation process of the dust collector 1 having the above-mentioned structure according to the illustrated embodiment of the present invention will be described with reference to FIG. 4.

When the vacuum cleaner (not shown) is driven in a state in which the dust collector 1 coupled as described above is mounted to the vacuum cleaner, the vacuum cleaner is formed at an inner passage thereof with a lower vacuum pressure than atmospheric pressure. The vacuum pressure formed within the vacuum cleaner generates suction force through a nozzle (not shown) or brush assembly (not shown) of the vacuum cleaner. Thus, dust of the cleaning surface is suctioned into the vacuum cleaner, together with air suctioned through the nozzle or the brush assembly.

Outdoor air containing the suctioned dust is introduced into the centrifuging region 21*a* of the centrifuging unit 20 through the inlet 25.

Furthermore, when the vacuum cleaner is driven, the dust collecting region 31 of the dust collecting unit 30 is also formed with vacuum pressure. Such formed vacuum pressure within the dust collecting region 31 acts as suction force to suction water stored in the water storage unit 50 into the dust collecting region 31. Accordingly, the water stored in the water storage unit 50 moves upwards through the water supply portions 40 by the suction force, and is then discharged into the dust collecting region 31 through the liquid droplet spray holes 32.

The vacuum pressure increases the kinetic energy of the water sprayed into the dust collecting unit 30. Thus, water which passes through the liquid droplet spray holes 32 having the small diameters is separated and sprayed in the form of liquid droplets having various sizes. In this case, since each of the liquid droplet spray holes 32 has a different diameter, each of the liquid droplets also has various sizes. Such sprayed liquid droplets having various sizes are evenly distributed throughout the dust collecting region 31.

In the above-mentioned liquid droplet generating process, each of the water supply portions 40 helps the water stored in the water storage unit 50 to be raised by a principle such as a capillary phenomenon up to a height at which the corresponding liquid droplet spray hole 32 is formed.

In accordance with the illustrated embodiment of the present invention, the dust collector 1 may spray liquid droplets into the dust collecting region 31 only by suction force of the vacuum pressure formed through operation of the vacuum cleaner without having a separate liquid droplet spraying means.

Together with the above-mentioned liquid droplet spraying process, air introduced into the centrifuging region 21*a* by vacuum pressure of the vacuum cleaner moves and rotates upwards along the passage guide 24 at the outer peripheral side of the exhaust tube 23.

When air containing dust moves and rotates towards the upper portion in the centrifuging region 21*a*, dust particles are separated from the rotated air by centrifugal force so as to be discharged to the dust collecting region 31 through the opened upper portion of the centrifuging tube 21.

In this case, liquid droplets evenly distributed throughout the upper portion of the centrifuging unit 20 are bound with fine dust particles which are not separated so as to enable cohesion of or increase in weight of the fine dust particles. Consequently, the fine dust particles are easily separated by centrifugal force. As a result, separation efficiency of fine dust particles may be improved in the centrifuging unit 20, thereby preventing blockage of a prefilter, an exhaust filter, or the like by the fine dust particles.

In addition, in order to rapidly move dust particles towards the base portion of the dust collecting region 31, the dust particles increase in weight by binding between liquid droplets evenly distributed throughout the dust collecting region 31 and dust particles discharged into the dust collecting region 31 or cohesion between dust particles. Consequently, fine dust particles, which float within the dust collecting region 31, are rapidly removed, thereby preventing the fine dust particles from flowing backwards into the centrifuging unit 20.

Furthermore, the liquid droplets allow dust particles collected at the base portion of the dust collecting region 31 to be in a wet state, thereby preventing scattering of the collected dust particles.

In the illustrated embodiment of the present invention, when the vacuum cleaner mounted with the above-mentioned dust collector 1 is operated, water stored in the water storage unit 50 is converted into liquid droplets so as to be sprayed into the dust collecting region 31, without having a separate liquid droplet spraying means.

When the vacuum cleaner is continuously used, waste 35 containing dust and water is collected at the base portion of the dust collecting region 31 while an amount of water in the water storage unit 50 is reduced. The water reduced in the water storage unit 50 is replenished through the water inlet 52*a* of the handle portion 52.

In addition, when disposing of the waste 35 containing dust and water collected within the dust collecting region 31, a user separates the dust collector 1 from the vacuum cleaner, and then opens the cover 10 so as to discharge the waste 35 by overturning the dust collector 1.

MODE FOR INVENTION

Although the dust collector 1 illustrated in FIGS. 1 to 4 according to the embodiment of the present invention includes the centrifuging unit 20 configured so as to discharge air downwards, the present invention may have a variety of configurations.

Figure 5:
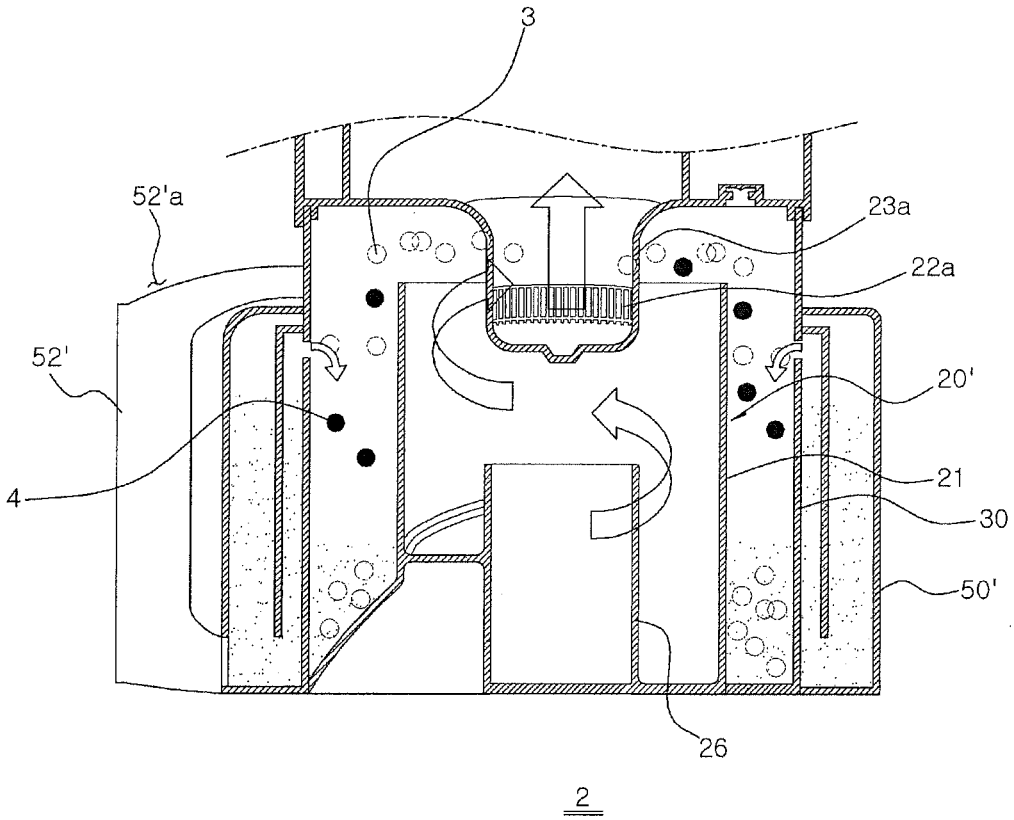
FIG. 5 is a sectional view illustrating a dust collector 2 according to another embodiment of the present invention.

FIG. 5 is a sectional view illustrating a dust collector 2 according to another embodiment of the present invention.

As shown in FIG. 5, the dust collector 2 according to another embodiment of the present invention includes a centrifuging unit 20' configured so as to discharge air upwards.

In the centrifuging unit 20' shown in FIG. 5, a stabilizer 26 is formed at a base portion in a centrifuging tube 21. In addition, an exhaust tube 23*a* having a grill 22*a* is formed at an upper surface in a dust container which faces an opened upper portion of the centrifuging tube 21. A handle portion 52' of a water storage unit 50' has a '⊏' shape, and is formed at an upper portion thereof with a water inlet 52*a'*.

Besides the above, the dust collector of the present invention may be implemented in various forms, such as a dust collector including a centrifuging unit in which a rotational axis of air has a predetermined slant or is leaned in a horizontal direction, a dust collector which includes a first separation unit having a first cyclone and a second separation unit having a second cyclone, a dust collector in which a centrifuging unit is installed outside a dust container, etc.

Also, the above-mentioned dust collector according to each illustrated embodiment of the present invention may further include an opening and closing cover at a lower portion thereof so as to discharge waste containing dust and water. In this case, the opening and closing cover includes a sealing member to prevent leakage of water, the water inlet 52*a* is provided with an airtight lid, and the cover 10 further includes fixing means so as not to be separated when the dust collector is overturned and a sealing means to prevent leakage of water.

INDUSTRIAL APPLICABILITY

The present invention may be applied to cleaning apparatuses such as domestic, business, industrial cleaners, and the like.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A dust collector for a vacuum cleaner comprising:

a dust collecting unit to collect dust particles discharged from a centrifuging unit; and a water storage unit to store water, wherein the dust collecting unit is formed at a side wall thereof with a plurality of liquid droplet spray holes so that liquid droplets are automatically sprayed into the dust collecting unit by vacuum pressure of the vacuum cleaner, and wherein the water storage unit is coupled to an outer side surface of the dust collecting unit so as to form a water storage region at an outer side of the dust collecting unit.

2. The dust collector according to claim 1, wherein each of the plural liquid droplet spray holes has a different diameter.

3. The dust collector according to claim 1, wherein each of the liquid droplet spray holes has a diameter of 0.3 mm to 10 mm.

4. The dust collector according to claim 1, wherein the water storage unit has a smaller volume than the volume of the dust collecting unit.

5. The dust collector according to claim 1, wherein the water storage unit further comprises a handle portion which has a water inlet opened at an upper portion thereof and is formed at a base portion thereof with a through hole to communicate with a water storage region of the water storage unit.

6. The dust collector according to claim 1, further comprising:

water supply portions located in the water storage unit while being respectively formed at positions of the liquid droplet spray holes.

7. The dust collector according to claim 6, wherein each of the water supply portions is formed at a base portion thereof to be submerged under the water stored in the water storage unit.

8. The dust collector according to claim 6, wherein each of the water supply portions is formed to have an inner diameter greater than a diameter of each liquid droplet spray hole.

9. The dust collector according to claim 6, wherein each of the water supply portions is vertically provided at an outer peripheral surface of the side wall of the dust collecting unit.

* * * * *

UNITED STATES PATENT AND TRADEMARK OFFICE

CERTIFICATE OF CORRECTION

PATENT NO. : 9,039,820 B2
APPLICATION NO. : 13/318008
DATED : May 26, 2015
INVENTOR(S) : Jung Gyun Han It is certified that error appears in the above-identified patent and that said Letters Patent is hereby corrected as shown below:

Title Page, item (54), Line 2

After "VACUUM" insert --CLEANER--.

Column 1, Line 2

After "VACUUM" insert --CLEANER--.

Signed and Sealed this
Thirteenth Day of October, 2015

Michelle K. Lee

Michelle K. Lee
*Director of the United States Patent and Trademark Office*